US011827950B2

(12) United States Patent
Ahn et al.

(10) Patent No.: US 11,827,950 B2
(45) Date of Patent: Nov. 28, 2023

(54) METHOD OF MANUFACTURING HIGH-STRENGTH STEEL SHEET HAVING EXCELLENT PROCESSABILITY

(71) Applicant: POSCO Co., Ltd, Pohang-si (KR)

(72) Inventors: Yeon-Sang Ahn, Gwangyang-si (KR); Chang-Hyo Seo, Gwangyang-si (KR); Kang-Hyun Choi, Gwangyang-si (KR); Eul-Yong Choi, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 0 days.

(21) Appl. No.: 17/992,240

(22) Filed: Nov. 22, 2022

(65) Prior Publication Data

US 2023/0080110 A1 Mar. 16, 2023

Related U.S. Application Data

(62) Division of application No. 16/767,858, filed as application No. PCT/KR2018/011965 on Oct. 11, 2018, now Pat. No. 11,519,051.

(30) Foreign Application Priority Data

Dec. 22, 2017 (KR) ..... 10-2017-0178003

(51) Int. Cl.

| | |
|---|---|
| ***C21D 9/46*** | (2006.01) |
| ***C21D 1/26*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/32*** | (2006.01) |
| ***C22C 38/60*** | (2006.01) |
| ***C23C 2/06*** | (2006.01) |
| ***C21D 8/02*** | (2006.01) |

(52) U.S. Cl.

CPC ..... *C21D 9/46* (2013.01); *C21D 1/26* (2013.01); *C21D 8/0226* (2013.01); *C21D 8/0236* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/32* (2013.01); *C22C 38/60* (2013.01); *C23C 2/06* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 9/46; C21D 1/26; C21D 8/0226; C21D 8/0236; C21D 2211/001; C21D 2211/002; C21D 2211/005; C21D 2211/008; C22C 38/001; C22C 38/02; C22C 38/04; C22C 38/06; C22C 38/12; C22C 38/14; C22C 38/32; C22C 38/60; C23C 2/06

See application file for complete search history.

(56) References Cited

U.S. PATENT DOCUMENTS

| | | | |
|---|---|---|---|
| 10,941,467 | B2 | 3/2021 | Seo et al. |
| 2009/0252641 | A1 | 10/2009 | Hoshi et al. |
| 2011/0017363 | A1 | 1/2011 | Kang et al. |
| 2011/0168300 | A1 | 7/2011 | Moulin et al. |
| 2012/0040203 | A1 | 2/2012 | Takagi et al. |
| 2013/0167980 | A1 | 7/2013 | Kawata et al. |
| 2014/0227555 | A1 | 8/2014 | Kawata et al. |
| 2014/0234657 | A1 | 8/2014 | Azuma et al. |
| 2014/0308156 | A1 | 10/2014 | Oh et al. |
| 2014/0342183 | A1 | 11/2014 | Wakabayashi et al. |
| 2016/0186282 | A1 | 6/2016 | Han et al. |
| 2017/0051378 | A1 | 2/2017 | Lee et al. |
| 2017/0260602 | A1 | 9/2017 | An et al. |
| 2017/0314116 | A1 | 11/2017 | Kawata et al. |
| 2017/0369974 | A1 | 12/2017 | Kim et al. |

(Continued)

FOREIGN PATENT DOCUMENTS

| | | |
|---|---|---|
| CA | 2990356 | 1/2017 |
| CN | 103917681 | 7/2014 |
| CN | 105734410 | 7/2016 |

(Continued)

OTHER PUBLICATIONS

Chashchin et al., Improving the Controlled Cooling of Hot-Rolled Steel Coils, Steel in Translation, 2010, vol. 40, No. 9, pp. 839-843.

Chinese Office Action—Chinese Application No. 201880079585.7 dated May 7, 2021, citing CN 107109588, CN 107075649, CN 105734410, KR 10-2011-0119285, CN 103917681, CN 107002207, CN 101326299, CN 101910439, and CN 107164695.

European Search Report—European Application No. 18892124.1 dated Aug. 24, 2020, citing EP 2426230, EP 1960562, Chashchin et al., EP 2256224, EP 2123786, US 2011/0017363, US 2017/0260602, US 2016/0186282, JP 5865516, KR 10-0711468, WO 2017/155263, CA 2990356, EP 2559782, and EP 3173494.

(Continued)

*Primary Examiner* — Anthony M Liang

(74) *Attorney, Agent, or Firm* — CANTOR COLBURN LLP

(57) ABSTRACT

Provided is a method of manufacturing a high strength steel sheet having excellent workability, including: reheating a steel slab; hot-rolling the reheated steel slab at an Ar3 transformation point or higher; coiling in a temperature range of 400 to 700° C.; primary cooling at a cooling rate of 0.1° C./s or less to room temperature; producing a cold rolled steel sheet at a cold reduction ratio of 40 to 70%; continuously annealing the cold rolled steel sheet in a temperature range of Ac1+30° C. to Ac3−20° C.; secondary cooling at a cooling rate of 10° C./s or less to 630 to 670° C.; third cooling to 400 to 500° C. at a cooling rate of 5° C./s or more in a hydrogen; maintaining for 70 seconds or more; hot-dip galvanizing; and performing a final cooling to Ms or less at a cooling rate of 1° C./s or more.

7 Claims, 3 Drawing Sheets

(56) References Cited

U.S. PATENT DOCUMENTS

| | | | |
|---|---|---|---|
| 2018/0002771 | A1 | 1/2018 | Han et al. |
| 2019/0071746 | A1 | 3/2019 | Han et al. |

FOREIGN PATENT DOCUMENTS

| | | |
|---|---|---|
| CN | 107002207 | 8/2017 |
| EP | 1960562 | 6/2007 |
| EP | 2123786 | 11/2009 |
| EP | 2256224 | 12/2010 |
| EP | 2426230 | 3/2012 |
| EP | 2559782 | 2/2013 |
| EP | 3173494 | 5/2017 |
| EP | 3372703 | 9/2018 |
| JP | 2005264176 | 9/2005 |
| JP | 2006009057 | 1/2006 |
| JP | 2010090432 | 4/2010 |
| JP | 5865516 | 2/2016 |
| JP | 2016180138 | 10/2016 |
| KR | 100711468 | 4/2007 |
| KR | 20110119285 | 11/2011 |
| KR | 20130034202 | 4/2013 |
| KR | 20140068222 | 6/2014 |
| KR | 20150073844 | 7/2015 |
| KR | 101561007 | 10/2015 |
| KR | 20150130612 | 11/2015 |
| KR | 20160078571 | 7/2016 |
| KR | 101677396 | 11/2016 |
| KR | 20170063785 | 6/2017 |
| WO | 2013047755 | 4/2013 |
| WO | 2013047820 | 4/2013 |
| WO | 2017155263 | 9/2017 |

OTHER PUBLICATIONS

International Search Report—PCT/KR2018/011965 dated Jan. 17, 2019.

Japanese Office Action—Japanese Application No. 2020-533604 dated Aug. 31, 2021, citing JP 2006-009057, CN 107109588, WO 2013/047820, and WO 2013/047755.

METHOD OF MANUFACTURING HIGH-STRENGTH STEEL SHEET HAVING EXCELLENT PROCESSABILITY

TECHNICAL FIELD

The present disclosure relates to a high-strength steel sheet used for an automobile structural member, and more particularly, to a high-strength steel sheet having excellent workability and a method of manufacturing the same.

BACKGROUND ART

In automobile materials, the use of high-strength steel sheets is required to improve fuel efficiency or durability of automobiles due to various environmental regulations and energy use regulations.

In general, as the strength of a steel sheet increases, elongation decreases, and as a result, there is a problem in that molding workability deteriorates. Therefore, there is a need to develop a material that may compensate therefor.

On the other hand, methods of strengthening steel include solid solution strengthening, precipitation strengthening, strengthening by grain refinement, and transformational strengthening. Thereamong, solid solution strengthening and strengthening by grain refinement are difficult in manufacturing high strength steel having a tensile strength of 490 MPa or higher.

Precipitation-reinforced high-strength steel is provided to strengthen the steel by forming a precipitate by adding carbide or nitride forming elements such as Cu, Nb, Ti, V, etc., or to secure the strength by refinement of grains by suppressing grain growth by fine precipitates. This has the advantage that the strength may be easily improved compared to the low manufacturing cost, while the recrystallization temperature is rapidly increased by the fine precipitates, and there is a disadvantage that high temperature annealing must be performed to ensure sufficient recrystallization and ductility. In addition, since the steel is strengthened by depositing carbide or nitride on the ferrite matrix, there is a limit to obtaining a high strength steel having a tensile strength of 600 MPa or more.

As a high-strength type of transformation-reinforced steel, ferrite-martensitic dual-phase steel containing hard martensite in a ferrite matrix, Transformation Induced Plasticity (TRIP) steel using the transformation induced plasticity of residual austenite, or Complex Phase (CP) steel which consists of low-temperature structure steel of ferrite and hard bainite or martensite, have been developed.

Recently, in addition to improving the fuel efficiency and durability of automobiles, high-strength steel plates with tensile strength of 780 MPa or higher have been used for body structures or reinforcing (members, seat rails, pillars, etc.) for safety against collision and passenger protection, and the usage amount thereof has increased.

However, as the strength gradually increases, cracks or wrinkles are generated in the process of press forming to manufacture a steel sheet as a component, and thus, a limit in manufacturing a complex component is reached.

To improve the workability of such a high-strength steel sheet, while satisfying the low yield ratio, which is the characteristic of the DP steel most widely used among transformation-reinforced high-strength steels, the ductility (El) and the strain hardening coefficient (n) compared to the existing DP steel should be improved, and if this may be realized, the application of a high-strength steel sheet as a material for manufacturing a complex part may be expanded.

On the other hand, as a technique for improving the workability of a high-strength steel sheet, Patent Document 1 discloses a steel sheet formed of a composite structure mainly composed of martensite. Specifically, to improve workability, a method of manufacturing a high-tensile steel sheet in which fine precipitated copper (Cu) particles having a particle diameter of 1 to 100 nm are dispersed inside a structure is proposed. However, to precipitate fine Cu particles, Cu must be added at a high content of 2 to 5% by weight, and in this case, there is a concern that red brittleness by Cu may occur, and manufacturing costs may be excessively increased.

As another example, Patent Document 2 discloses a steel sheet with improved strength, which has a microstructure containing 2-10% by area of pearlite with ferrite as the matrix and in which precipitation strengthening and grain refinement are performed by adding elements such as Nb, Ti and V, which are precipitation strengthening elements. In this case, although the hole expandability of the steel sheet is good, there is a limit in increasing the tensile strength, and the yield strength is high and the ductility is low, so there may be a problem of cracks or the like during press forming.

As another example, Patent Document 3 discloses a cold rolled steel sheet that simultaneously obtains high strength and high ductility by utilizing the tempered martensite phase and also has an excellent plate shape after continuous annealing. However, in this case, the content of carbon (C) is as high as 0.2% or more, and there is a problem in that weldability is inferior and a dent defect in the furnace due to the addition of a large amount of Si may occur.

(Patent Document 1) Japanese Patent Laid-Open Publication No. 2005-264176

(Patent Document 2) Korean Patent Application Publication No. 2015-0073844

(Patent Document 3) Japanese Patent Laid-Open Publication No. 2010-090432

DISCLOSURE

Technical Problem

According to an aspect of the present disclosure, in providing a high-strength steel sheet having a tensile strength of 780 MPa or higher, the high-strength steel sheet has excellent ductility (El) and strain hardening coefficient (n) while having a relatively low yield ratio, thereby exhibiting improved workability.

Technical Solution

According to an aspect of the present disclosure, a high strength steel sheet having excellent workability includes:

in weight %, 0.06 to 0.18% of carbon (C), 1.5% or less (excluding 0%) of silicon (Si), 1.7 to 2.5% of manganese (Mn), 0.15% or less (excluding 0%) of molybdenum (Mo), 1.0% or less (excluding 0%) of chromium (Cr), 0.1% or less of phosphorus (P), 0.01% or less of sulfur (S), 1.0% or less (excluding 0%) of aluminum (Al), 0.001 to 0.04% of titanium (Ti), 0.001 to 0.04% of niobium (Nb), 0.01% or less of nitrogen (N), 0.01% or less (excluding 0%) of boron (B), 0.05% or less (excluding 0%) of antimony (Sb), and a remainder of Fe and other inevitable impurities, and as a microstructure, ferrite having an area fraction of 40% or more, and bainite, fresh martensite and retained austenite as a remainder, wherein a ratio (Mb/Mt) of a total fraction (Mt) of the fresh martensite and a fraction (Mb) of fresh martensite adjacent to the bainite is 60% or more, and a ratio (Ms/Mt) of the total fraction (Mt) of the fresh martensite and a fraction (Ms) of fine fresh martensite having an average particle size of 3 μm or less is 60% or more.

According to another aspect of the present disclosure, a method of manufacturing a steel sheet having excellent workability, includes reheating a steel slab satisfying the above-mentioned alloy composition at a temperature in a range of 1050 to 1300° C.; preparing a hot-rolled steel sheet by finishing hot-rolling the reheated steel slab at an Ar3 transformation point or higher; coiling the hot rolled steel sheet in a temperature range of 400 to 700° C.; after the coiling, primary cooling at a cooling rate of 0.1° C./s or less to room temperature; after the cooling, producing a cold rolled steel sheet by cold rolling at a cold reduction ratio of 40 to 70%; continuously annealing the cold rolled steel sheet in a temperature range of Ac1+30° C. to Ac3−20° C.; after the continuously annealing, performing a secondary cooling at a cooling rate of 10° C./s or less (excluding 0° C./s) to 630 to 670° C.; after the secondary cooling, performing a third cooling to 400 to 500° C. at a cooling rate of 5° C./s or more in a hydrogen cooling facility; maintaining for 70 seconds or more after the third cooling; hot-dip galvanizing after the maintaining; and after the hot-dip galvanizing, performing a final cooling to Ms or less at a cooling rate of 1° C./s or more.

Advantageous Effects

According to an exemplary embodiment, a steel sheet having improved workability may be provided even in the case of having high strength, by the optimization of an alloy composition and manufacturing conditions.

As described above, since the steel sheet having improved workability according to an exemplary embodiment may prevent processing defects such as cracks or wrinkles during press forming, thereby an effect of appropriately applying the steel sheet to components for structures, and the like, requiring processing into a complicated shape.

BEST MODE FOR INVENTION

Figure 1:
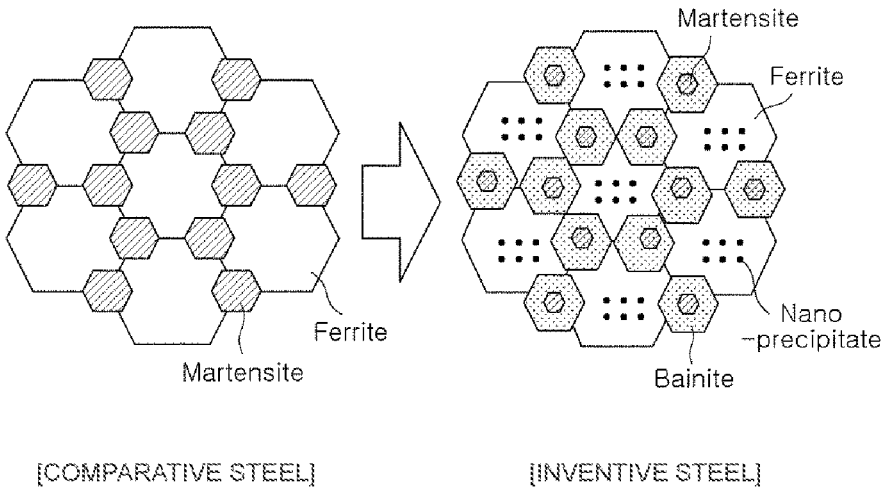
FIG. 1 schematically illustrates the microstructure shapes of a comparative steel and an inventive steel according to an exemplary embodiment of the present disclosure. In this case, the microstructure shape of the inventive steel is illustrated as an example, and is not limited to the illustrated shape.

The inventors of the present disclosure have studied in depth to develop materials having a level of workability that may be suitably used in components that require processing into complex shapes from among materials for automobiles.

As a result, it was confirmed that a high-strength steel sheet having a structure advantageous for securing target physical properties may be provided by optimizing the alloy composition and the manufacturing conditions, and the present disclosure has been completed.

In detail, it has been found that the present disclosure introduces a small amount of bainite in the final structure to form fresh martensite around the bainite grain boundary, thereby uniformly dispersing the martensite and refining the size thereof to diffuse effective deformation at the beginning of processing. For this reason, it will have technical significance in that the strain hardening rate may be significantly improved, and ductility may be significantly increased by alleviating local stress concentration.

Hereinafter, an exemplary embodiment of the present disclosure will be described in detail.

A high-strength steel sheet having excellent workability according to an exemplary embodiment, may preferably include, in weight %, 0.06 to 0.18% of carbon (C), 1.5% or less (excluding 0%) of silicon (Si), 1.7 to 2.5% of manganese (Mn), 0.15% or less (excluding 0%) of molybdenum (Mo), 1.0% or less (excluding 0%) of chromium (Cr), 0.1% or less of phosphorus (P), 0.01% or less of sulfur (S), 1.0% or less (excluding 0%) of aluminum (Al), 0.001 to 0.04% of titanium (Ti), 0.001 to 0.04% of niobium (Nb), 0.01% or less of nitrogen (N), 0.01% or less (excluding 0%) of boron (B), and 0.05% or less (excluding 0%) of antimony (Sb).

Hereinafter, the reason for controlling the alloy composition of the high-strength steel sheet as described above will be described in detail. In this case, unless otherwise specified, the content of each alloy composition indicates weight percent.

C: 0.06 to 0.18%

Carbon (C) is the main element added to strengthen the transformation structure of steel. This C promotes high strength of the steel and promotes the formation of martensite in the composite structure steel. As the C content increases, the amount of martensite in steel increases.

However, if the content of C exceeds 0.18%, the strength increases due to the increase in the amount of martensite in steel, but the difference in strength with ferrite having a relatively low carbon concentration increases. Due to such a difference in strength, breakage occurs easily at an interface between phases when stress is applied. Therefore, there is a problem in that the ductility and the strain hardening rate decrease. In addition, there is a problem in that weldability may be inferior and welding defects may occur during processing of client components. On the other hand, if the content of C is less than 0.06%, it may be difficult to secure the target strength.

Therefore, in an exemplary embodiment, it may be preferable to control the content of C to be 0.06 to 0.18%. In detail, C may be contained in an amount of 0.08% or more, and in more detail, 0.1% or more.

Si: 1.5% or Less (Excluding 0%)

Silicon (Si) is a ferrite stabilizing element, and is an element that promotes ferrite transformation and promotes martensite formation by promoting C concentration into untransformed austenite. In addition, silicon has an excellent solid solution strengthening effect, and is effective in reducing the difference in hardness between phases by increasing the strength of ferrite, and is an element useful for securing strength without lowering the ductility of the steel sheet.

If the content of Si exceeds 1.5%, surface scale defects are caused, resulting in inferior plating surface quality and impairing chemical conversion coating.

Therefore, in an exemplary embodiment of the present disclosure, it may be preferable to control the content of Si to 1.5% or less, and 0% is excluded. In detail, Si may be included in the amount of 0.3 to 1.0%.

Mn: 1.7-2.5%

Manganese (Mn) has the effect of refining particles without deteriorating ductility and preventing hot brittleness by the formation of FeS by precipitating sulfur (S) in the steel as MnS. In addition, Mn is an element that strengthens the steel, and at the same time, serves to lower the critical cooling rate at which the martensite phase is obtained in the composite structure steel. Therefore, Mn is useful for more easily forming martensite.

If the content of Mn as described above is less than 1.7%, the above-described effect cannot be obtained, and there is a difficulty in securing the strength of the target level. On the other hand, if the Mn content exceeds 2.5%, there is a high possibility of problems in areas such as weldability and hot rolling property, and the material may be unstable due to excessive formation of martensite, and an Mn-Band (an Mn oxide band) may be formed in the structure, thereby causing a problem in which the risk of occurrence of processing cracks and plate breakage increases. In addition, there is a problem in that Mn oxide is eluted on the surface during annealing, which greatly inhibits plating properties.

Therefore, in an exemplary embodiment of the present disclosure, it may be preferable to control the Mn content to be 1.7 to 2.5%. In more detail, Mn may be included in an amount of 1.8 to 2.3%.

Mo: 0.15% or Less (Excluding 0%)

Molybdenum (Mo) is an element added to delay the transformation of austenite into pearlite, and at the same time, to refine the ferrite and improve the strength. This Mo has the advantage of improving the hardenability of the steel to form martensite finely on the grain boundary, thereby controlling the yield ratio. However, as Mo is an expensive element, the higher the content is, the more disadvantageous it is in manufacturing. Therefore, it may be preferable to appropriately control the Mn content.

To sufficiently obtain the above-described effect, the Mo may be added at a maximum of 0.15%. If the content exceeds 0.15%, it causes a rapid rise in the cost of an alloy, and the economic efficiency decreases. Further, due to the excessive grain refinement effect and solid solution strengthening effect, the ductility of the steel also decreases.

Therefore, in an exemplary embodiment of the present disclosure, it may be preferable to control the content of Mo to 0.15% or less, and 0% is excluded.

Cr: 1.0% or Less (Excluding 0%)

Chromium (Cr) is an element added to improve the hardenability of steel and ensure high strength. Such Cr is effective for forming martensite, and may be advantageous in the manufacture of composite structure steel having high ductility by significantly reducing the decrease in ductility compared to the increase in strength. In detail, a Cr-based carbide such as $Cr_{23}C_6$ is formed in the hot rolling process, and partially dissolves and some thereof remain undissolved in the annealing process. Some of the Cr-based carbide, remaining undissolved, may control the amount of solid solution C in the martensite to be an appropriate level or lower after cooling. Therefore, chromium may have a favorable effect in producing composite structural steel in which the generation of yield point elongation (YP-El) is suppressed and a yield ratio is relatively low.

In an exemplary embodiment of the present disclosure, the addition of Cr promotes hardenability improvement and facilitates the formation of martensite, but if the Cr content exceeds 1.0%, the effect is not only saturated, but the hot rolling strength is excessively increased. Therefore, there is a problem in which cold rolling property is inferior. In addition, there is a problem in which the elongation rate is lowered by increasing the fraction of the Cr-based carbide and coarsening the Cr-based carbide so that the size of martensite after annealing is increased.

Therefore, in an exemplary embodiment of the present disclosure, it may be preferable to control the Cr content to be 1.0% or less, and 0% is excluded.

P: 0.1% or Less

Phosphorus (P) is a substitutional element having a greatest solid solution strengthening effect, and is an element that is advantageous in improving in-plane anisotropy and securing strength without significantly lowering formability. However, in a case in which the P is excessively added, the possibility of brittle fracture is greatly increased, which increases the likelihood of slab plate fracture during hot rolling, and there is a problem of inhibiting the plating surface properties.

Therefore, in an exemplary embodiment of the present disclosure, it may be preferable to control the content of P to 0.1% or less, and considering the inevitably added level of P, 0% is excluded.

S: 0.01% or Less

Sulfur (S) is an element that is inevitably added as an impurity element in steel, and it is desirable to manage the S content as low as possible because it inhibits ductility and weldability. In detail, since the S has a problem of increasing the possibility of generating red brittleness, it may be preferable to control the S content to 0.01% or less. However, 0% is excluded considering the level inevitably added during the manufacturing process.

Al: 1.0% or Less (Excluding 0%)

Aluminum (Al) is an element added to refine the particle size of steel and deoxidize the steel. Also, as a ferrite stabilizing element, it is effective to improve the martensitic hardenability by distributing the carbon in ferrite into austenite, and is an element effective to improve the ductility of the steel sheet by effectively suppressing precipitation of carbides in bainite when held in the bainite region.

When the content of Al exceeds 1.0%, the strength improvement by the grain refinement effect is advantageous, while the possibility of surface defects in the plated steel sheet increases due to excessive inclusions during the steelmaking continuous casting operation. In addition, there is a problem of increasing the manufacturing cost.

Therefore, in an exemplary embodiment of the present disclosure, it may be preferable to control the content of Al to be 1.0% or less, and 0% is excluded. In more detail, Al may be included in an amount of 0.7% or less.

Ti: 0.001 to 0.04%, Nb: 0.001 to 0.04%

Titanium (Ti) and niobium (Nb) are effective elements for increasing of strength and grain refinement by the formation of fine precipitates. In detail, Ti and Nb are combined with C in steel to form a nano-sized fine precipitate, which serves to strengthen the matrix structure and reduce the difference in hardness between phases.

If the content of each of Ti and Nb is less than 0.001%, the above-described effects cannot be sufficiently secured. On the other hand, if the each content exceeds 0.04%, manufacturing costs increase and precipitates are excessively formed, which may greatly inhibit ductility.

Therefore, in an exemplary embodiment of the present disclosure, it may be preferable to control the Ti and Nb to 0.001 to 0.04%, respectively.

N: 0.01% or Less

Nitrogen (N) is an effective element for stabilizing austenite, but if the content exceeds 0.01%, the refining cost of steel rises sharply, and the risk of occurrence of cracking during the continuous casting operation increases greatly by the formation of AlN precipitate.

Therefore, in an exemplary embodiment of the present disclosure, it may be preferable to control the content of N to be 0.01% or less, but considering the level inevitably added, 0% is excluded.

B: 0.01% or Less (Excluding 0%)

Boron (B) is an advantageous element for retarding the transformation of austenite into pearlite in a process of cooling during annealing. In addition, boron is a hardenability element that inhibits ferrite formation and promotes martensite formation.

If the B content exceeds 0.01%, excessive B is concentrated on the surface, causing a problem of deterioration of plating adhesion.

Therefore, in an exemplary embodiment of the present disclosure, it may be preferable to control the content of B to be 0.01% or less, and 0% is excluded.

Sb: 0.05% or Less (Excluding 0%)

Antimony (Sb) is distributed in grain boundaries and serves to delay diffusion of oxidizing elements such as Mn, Si, Al, and the like through grain boundaries. Therefore, antimony suppresses the surface concentration of oxide, and has an advantageous effect in suppressing the coarsening of the surface concentrate depending on the temperature rise and the hot rolling process change.

If the content of Sb exceeds 0.05%, the effect is not only saturated, but also increases the manufacturing costs and deteriorates workability.

Therefore, in an exemplary embodiment of the present disclosure, it may be preferable to control the content of Sb to 0.05% or less, and 0% is excluded.

The remaining component in the exemplary embodiment is iron (Fe). However, in the normal manufacturing process, unintended impurities from the raw material or the surrounding environment may inevitably be incorporated, and therefore cannot be excluded. Since these impurities are known to anyone skilled in the ordinary manufacturing process, all the contents thereof are not specifically mentioned in this specification.

On the other hand, to secure the workability by improving the stain hardening rate and ductility together with the high strength targeted in an exemplary embodiment of the present disclosure, the microstructure of the steel sheet satisfying the above-described alloy composition needs to be configured as follows.

In detail, it may be preferable that the high-strength steel sheet of the present disclosure includes a microstructure of ferrite having an area fraction of 40% or more, and bainite, fresh martensite and retained austenite, as a remainder.

By forming a small amount of bainite phase in the remaining structure, for example, 30% by area or less (excluding 0% by area), an effect of reducing the difference in hardness between the phases of ferrite and martensite may be obtained.

In more detail, 55 area % or less of ferrite may be included, and 35 area % or less of fresh martensite phase may be included.

In addition, in the high strength steel sheet of the present disclosure, it may be preferable that a ratio (Mb/Mt) of a total fraction (Mt) of the fresh martensite and a fraction (Mb) of fresh martensite adjacent to the bainite is 60% or more, and a ratio (Ms/Mt) of the total fraction (Mt) of the fresh martensite and a fraction (Ms) of fine fresh martensite having an average particle size of 3 μm or less is 60% or more.

In this case, being adjacent to bainite indicates that it exists around the bainite phase. As an example, a fresh martensite phase may be present in the bainite phase, as illustrated in FIG. 1. As another example, a fresh martensite phase may be present around the grain boundary of the bainite phase, but the present disclosure is not limited thereto.

As illustrated in FIG. 1, the present disclosure introduces a small amount of bainite phase, and a fresh martensite is formed in or around the bainite phase, thereby forming a fine fresh martensite phase as a whole such that the formation of martensite bands inhibiting workability may be suppressed, while uniformly dispersing fresh martensite in the steel.

However, if the occupancy ratio (Mb/Mt) of fresh martensite adjacent to bainite is less than 60%, the occupancy ratio (Ms/Mt) of fine fresh martensite with an average particle size of less than 3 μm may not be secured to be 60% or more, and thus, the sufficient dispersion effect of fresh martensite may not be obtained, and there is a concern that a martensite band structure may be formed.

On the other hand, in an exemplary embodiment of the present disclosure, the structure in which Mb/Mt is 60% or more and Ms/Mt is 60% or more, while forming the above-described structure, for example, the bainite phase, may be obtained as the relationship between C, Si, Al, Mn, Mo and Cr, among the alloy elements described above, satisfies the following relationship 1 and manufacturing conditions to be described later are controlled.

$$(Si+Al+C)/(Mn+Mo+Cr) \geq 0.25 \quad \text{[Relationship 1]}$$

(where respective elements indicate the weight content.)

In [Relationship 1], Si and Al are ferrite stabilizing elements that promote ferrite transformation and contribute to the formation of martensite by promoting C concentration into untransformed austenite. C is also an element that contributes to the formation of martensite and adjustment of fraction by promoting C concentration in untransformed austenite. On the other hand, Mn, Mo, and Cr are elements contributing to the improvement of hardenability, but the effect of contributing to C concentration in austenite, such as Si, Al and C, is relatively low. Therefore, by controlling the ratio of Si, Al and C, which promotes C concentration into austenite, and Mn, Mo and Cr, which are advantageous for improving hardenability, a microstructure intended in an exemplary embodiment of the present disclosure may be obtained.

Figure 2:
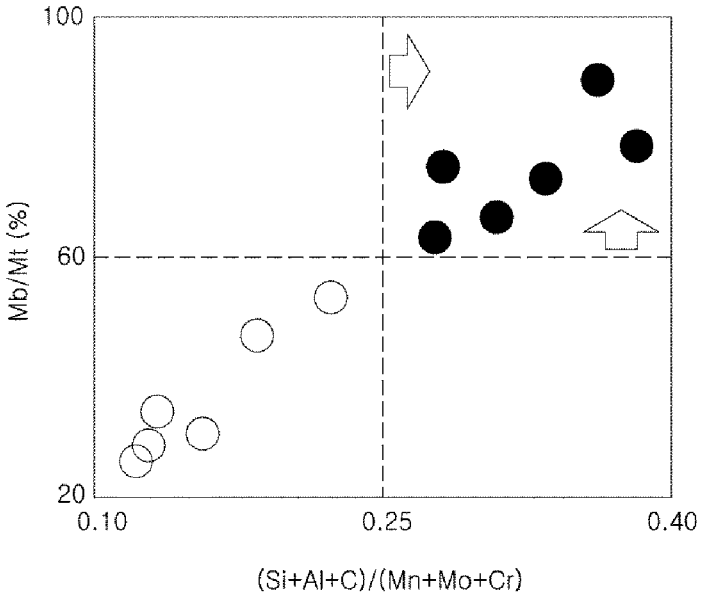
FIG. 2 illustrates a change in a phase occupancy ratio (Mb/Mt) depending on the concentration ratio (corresponding to Relationship 1) between C, Si, Al, Mn, Mo and Cr of the inventive steel and the comparative steel in an exemplary embodiment of the present disclosure.

In more detail, when the component relationship of C, Si, Al, Mn, Mo and Cr at a ¼*t* (where t indicates the thickness (mm) of the steel sheet) point of the steel sheet in the thickness direction provided in an exemplary embodiment of the present disclosure satisfies Relationship 1, the occupancy ratio (Mb/Mt) of fresh martensite adjacent to bainite may be secured to be 60% or more (see FIG. 2).

The high-strength steel sheet of the present disclosure has the above-described structure, thereby significantly reducing the difference in hardness between phases, and the deformation starts at a low stress in the initial stage of plastic deformation, thereby lowering the yield ratio, such that the deformation during processing may be effectively dispersed to increase the strain hardening rate.

In addition, the above-described structure may improve the ductility by delaying the generation, growth and coalescence of voids that cause ductile fracture by alleviating the concentration of local stress and strain after necking.

In detail, the high-strength steel sheet according to an exemplary embodiment of the present disclosure may have a tensile strength of 780 MPa or more, and in addition, the relationship of a strain hardening coefficient (n), ductility (EI), tensile strength (TS), and a yield ratio (YR) measured in a strain section of 4 to 6% may satisfy the following Relationship 2.

$$(n \times EI \times TS)/YR \geq 5000 \quad \text{[Relationship 2]}$$

(where the unit is MPa %.)

In addition, the high-strength steel sheet of the present disclosure may further significantly reduce the difference in hardness between phases by forming nano-sized precipitates in ferrite. In this case, the nano-sized precipitate may be an Nb-based and/or Ti-based precipitate having an average size of 30 nm or less, in detail, 1 to 30 nm, based on a circle equivalent diameter.

Furthermore, the high-strength steel sheet of the present disclosure may include a zinc-based plating layer on at least one surface.

Hereinafter, a method of manufacturing a high-tensile steel having excellent workability according to another exemplary of the present disclosure will be described in detail.

Briefly, according to an embodiment of the present disclosure, a high-strength steel sheet targeted through a process of [steel slab reheating-hot rolling-coiling-cold rolling-continuous annealing-cooling-hot dip galvanizing-cooling] may be manufactured, and the conditions for respective operations are described as follows.

[Steel Slab Reheating]

First, the steel slab having the above-described component system is reheated. This process is performed to smoothly perform a subsequent hot rolling process and to obtain sufficient properties of the target steel sheet. In an exemplary embodiment of the present disclosure, the process conditions of such a reheating process are not particularly limited, and may be any ordinary conditions. As an example, the reheating process may be performed in a temperature range of 1050 to 1300° C.

[Hot Rolling]

The steel slab heated as described above may be subjected to finish hot-rolling at an Ar3 transformation point or higher, and at hit time, it may be preferable that the outlet temperature satisfies Ar3 to Ar3+50° C.

If the temperature at the outlet side of the finish hot rolling is less than Ar3, ferrite and austenite dual-phase region rolling is performed, which may cause material unevenness. On the other hand, if the temperature exceeds Ar3+50° C., there is a concern that material irregularity may occur due to the formation of an abnormal coarse grain by high temperature hot rolling, which causes a problem of coil distortion during subsequent cooling.

On the other hand, the temperature of an inlet side during the finish hot rolling may be in the temperature range of 800 to 1000° C.

[Coiling]

It may be preferable coiling the hot-rolled steel sheet manufactured as described above.

It may be preferable that the coiling is performed at a temperature in a range of 400 to 700° C. If the coiling temperature is less than 400° C., excessive martensite or bainite formation causes excessive strength rise of the hot rolled steel sheet, thereby causing problems such as poor shape or the like due a load during cold rolling. On the other hand, if the coiling temperature exceeds 700° C., surface concentration and internal oxidation of elements such as Si, Mn, B or the like in steel, which lower hot dip galvanizing wettability, may be increased.

[1st Cooling]

It may be preferable to cool the coiled hot-rolled steel sheet to room temperature at an average cooling rate of 0.1° C./s or less (excluding 0° C./s). In more detail, the cooling may be performed at an average cooling rate of 0.05° C./s or less, and in further detail, 0.015° C./s or less.

As described above, by cooling the coiled hot-rolled steel sheet at a slow cooling rate, a hot-rolled steel sheet in which carbides serving as nucleation sites for austenite are finely dispersed may be obtained. For example, by uniformly dispersing the fine carbide in the steel during the hot rolling process, the austenite may be finely dispersed and formed while the carbide is dissolved during annealing. Therefore, after the annealing is completed, the uniformly dispersed fine martensite may be obtained.

[Cold Rolling]

The coiled and cooled hot rolled steel sheet may be cold rolled to produce a cold rolled steel sheet.

In this case, it may be preferable that the cold rolling is performed at a cold reduction ratio of 40 to 70%. If the cold reduction ratio is less than 40%, it may be difficult to secure a target thickness, and there is a problem in which correction of the steel sheet shape is difficult. On the other hand, if the cold rolling reduction ratio exceeds 70%, there is high possibility of occurrence of cracks at the edge portion of the steel sheet, and there is a problem in which a cold rolling load is caused.

[Continuous Annealing]

It may be preferable to continuously anneal the cold rolled steel sheet produced as described above. The continuous annealing treatment may be performed, for example, in a continuous galvannealing line.

The continuous annealing operation is a process for forming ferrite and austenite phases simultaneously with recrystallization and for decomposing carbon.

The continuous annealing treatment may preferably be performed at a temperature in the range of Ac1+30° C. to Ac3−20° C., and more advantageously, at a temperature in the range of 770° C. to 820° C.

If the temperature is less than Ac1−20° C. during the continuous annealing, not only sufficient recrystallization may not be achieved, but also sufficient austenite formation may be difficult, and thus, it may be impossible to secure a fraction of the martensite phase and bainite phase at the target level after annealing. On the other hand, if the temperature exceeds Ac3+30° C., productivity decreases, and the austenite phase is excessively formed such that the fraction of the martensite phase and bainite phase increases significantly after cooling, and yield strength increases and ductility decreases, resulting in difficulty in securing a low yield ratio and high ductility. In addition, there is a possibility that surface concentration may increase due to elements that inhibit the wettability of hot-dip galvanizing, such as Si, Mn, B or the like, and thus, the plating surface quality may deteriorate.

[Stepwise Cooling]

It may be preferable to cool, in stepwise, the cold-rolled steel sheet having been subjected to the continuous annealing as described above.

In detail, it may be preferable to perform the cooling (this cooling is referred to as secondary cooling) to 630 to 670° C. at an average cooling rate of 10° C./s or less (excluding 0° C./s), and then to perform the cooling (this cooling is referred to as third cooling) to 400 to 500° C. at an average cooling rate of 5° C./s or more.

If the end temperature of the second cooling is less than 630° C., the diffusion activity of carbon is low due to too low temperature, thereby increasing the carbon concentration in the ferrite, increasing the yield ratio and increasing the occurrence of cracks during processing. On the other hand, if the end temperature exceeds 670° C., it is advantageous in terms of carbon diffusion, but is disadvantageous in that an excessively high cooling rate is required for subsequent cooling (the third cooling). In addition, if the average cooling rate of the second cooling exceeds 10° C./s, sufficient carbon diffusion may not be performed. Meanwhile, the lower limit of the average cooling rate is not particularly limited, but may be at 1° C./s or more in consideration of productivity.

After completing the secondary cooling under the above-described conditions, it may be preferable to perform the third cooling. In the third cooling, if the end temperature is less than 400° C. or exceeds 500° C., introduction of bainite phase may be difficult. Therefore, it may be impossible to effectively lower the difference in hardness between phases. In addition, if the average cooling rate during the third cooling is less than 5° C./s, there is a concern that the bainite phase may not be formed at the target level. On the other hand, the upper limit of the average cooling rate is not particularly limited, and may be appropriately selected by a person skilled in the art in consideration of the specifications of the cooling equipment. As an example, the third cooling may be performed at 100° C./s or less.

In addition, the third cooling may use a hydrogen cooling facility using hydrogen gas ($H_2$ gas). As described above, by performing cooling using a hydrogen cooling facility, an effect of suppressing surface oxidation that may occur during the third cooling may be obtained.

On the other hand, in the stepwise cooling as described above, the cooling rate during the third cooling may be faster than the cooling rate during the second cooling, and in an exemplary embodiment of the present disclosure, the bainite phase may be formed during the third cooling under the above-described conditions.

[Maintaining]

After completing the stepwise cooling as described above, it may be preferable to maintain at 70 seconds or more in the cooled temperature range.

This is to concentrate the carbon on the untransformed austenite phase adjacent to the bainite phase formed during the above-described third cooling. For example, it is intended to form a fine fresh martensite phase in an area adjacent to bainite after completing all subsequent processes.

In this case, if the holding time is less than 70 seconds, the amount of carbon concentrated on the untransformed austenite phase is insufficient, and thus, the intended microstructure may not be secured.

In more detail, it may be maintained within 70 to 200 seconds.

[Hot-Dip Galvanizing]

It may be preferable to manufacture a hot-dip galvanized steel sheet by dipping the steel sheet in a hot-dip galvanizing bath after the stepwise cooling and maintenance process as described above.

In this case, hot dip galvanizing may be performed under normal conditions, but for example, may be performed at a temperature within a range of 430 to 490° C. In addition, the composition of the hot-dip galvanizing bath during the hot-dip galvanizing is not particularly limited. The hot-dip galvanizing bath may be a pure galvanizing bath or a zinc-based alloy plating bath containing Si, Al, Mg, and the like.

[Final Cooling]

After completion of the hot dip galvanizing, it may be preferable to perform the cooling to Ms (a martensitic transformation start temperature) or less at a cooling rate of 1° C./s or more. In this process, a fine fresh martensite phase may be formed in a region of the steel sheet (where the steel sheet corresponds to a base material of a lower portion of the plated layer), adjacent to the bainite phase.

When the end temperature of the cooling exceeds Ms, the sufficient fresh martensite phase may not be secured, and if the average cooling rate is less than 1° C./s, there is a concern that the fresh martensite phase may be unevenly formed due to too slow cooling rate. In more detail, cooling may be performed at a cooling rate of 1 to 100° C./s.

Even when cooling is performed to room temperature during the cooling, there is no problem in securing a target structure, and in this case, the room temperature may be represented as about 10 to 35° C.

On the other hand, if necessary, an alloyed hot-dip galvanized steel sheet may be obtained by alloying heat treatment of the hot-dip galvanized steel sheet before final cooling. In an exemplary embodiment of the present disclosure, the conditions for the alloying heat treatment process are not particularly limited, and may be any ordinary conditions. As an example, an alloying heat treatment process may be performed at a temperature in a range of 480 to 600° C.

Next, if necessary, by subjecting the final cooled hot-dip galvanized steel sheet or alloyed hot-dip galvanized steel sheet to temper rolling, a large amount of dislocation is formed in the ferrite located around the martensite to further improve the bake hardenability.

At this time, the reduction ratio may preferably be less than 1.0% (excluding 0%). If the reduction ratio is 1.0% or more, it is advantageous in terms of dislocation formation, but side effects such as occurrence of plate breakage and the like may be caused due to limitations in facility capability.

The high-strength steel sheet of the present disclosure prepared as described above may include a microstructure of ferrite having an area fraction of 40% or more, and bainite, fresh martensite and retained austenite, as a remainder. In addition, a ratio (Mb/Mt) of a total fraction (Mt) of the fresh martensite and a fraction (Mb) of martensite adjacent to the bainite satisfies 60% or more, and a ratio (Ms/Mt) of the total fraction (Mt) of the fresh martensite and a fraction (Ms) of fine fresh martensite having an average particle size of 3 μm or less satisfies 60% or more, thereby obtaining an effect of significantly reducing the difference in hardness between phases.

Hereinafter, the present disclosure will be described in more detail through examples. However, it is necessary to note that the following examples are only intended to illustrate the present disclosure in more detail and are not intended to limit the scope of the present disclosure. This is because the scope of the present disclosure is determined by the items described in the claims and the items reasonably inferred therefrom.

MODE FOR INVENTION

Example

After preparing a steel slab having the alloy composition illustrated in Table 1 below, the steel slab was heated to a temperature in a range of 1050 to 1250° C., and then hot rolled, cooled, and coiled under the conditions illustrated in Table 2 to prepare a hot rolled steel sheet.

Thereafter, each hot rolled steel sheet was pickled, and then cold rolled at a cold rolling reduction ratio of 40 to 70% to prepare a cold rolled steel sheet, and then subjected to continuous annealing under the conditions illustrated in Table 2 below, followed by stepwise cooling (2nd and 3rd), and then, was maintained in the range of 70 to 100 seconds at the third cooling end temperature. In this case, the third cooling was performed in a hydrogen cooling facility.

Thereafter, zinc plating was performed in a hot-dip galvanizing bath (0.1 to 0.3% Al-residual Zn) at 430 to 490° C., followed by final cooling and followed by temper rolling to 0.2%, to prepare a hot-dip galvanized steel sheet.

The microstructure was observed for each steel sheet prepared as described above, and mechanical and plating properties were evaluated, and the results are illustrated in Table 3 below.

In this case, the tensile test for each test piece was performed in the L direction using ASTM standards. In addition, the strain hardening rate (n) was measured for the strain hardening rate value in a strain rate section of 4 to 6% in the VDA (German Automobile Association) standard.

Then, the microstructure fraction was analyzed for matrix structure at a point of ¼t of the thickness of the steel sheet. In detail, the fraction of ferrite, bainite, fresh martensite, and austenite was measured using FE-SEM and an image analyzer after Nital corrosion.

On the other hand, the concentrations of C, Si, Al, Mn, Mo and Cr at ¼*t* point of each steel sheet were measured using Transmission Electron Microscopy (TEM), Energy Dispersive Spectroscopy (EDS), and ELLS analysis equipment.

Furthermore, whether or not unplated steel sheets occurred was checked by SEM to determine presence or absence of a region in which a plating layer was not formed. In the case of presence of the region in which a plating layer was not formed, it was evaluated as being unplated.

TABLE 1

| | Alloy Composition (weight %) | | | | | | | | | | | | | Component |
|---|---|---|---|---|---|---|---|---|---|---|---|---|---|---|
| Classification | C | Si | Mn | P | S | Al | Mo | Cr | Ti | Nb | N | B | Sb | Ratio |
| Inventive Steel 1 | 0.14 | 0.60 | 2.0 | 0.020 | 0.003 | 0.03 | 0.001 | 0.02 | 0.002 | 0.020 | 0.005 | 0.005 | 0.02 | 0.38 |
| Inventive Steel 2 | 0.12 | 0.30 | 1.85 | 0.020 | 0.003 | 0.33 | 0.02 | 0.20 | 0.020 | 0.002 | 0.006 | 0.001 | 0.021 | 0.36 |
| Inventive Steel 3 | 0.13 | 0.50 | 2.1 | 0.021 | 0.007 | 0.20 | 0.03 | 0.34 | 0.001 | 0.023 | 0.004 | 0.002 | 0.025 | 0.34 |
| Inventive Steel 4 | 0.09 | 0.60 | 2.3 | 0.023 | 0.005 | 0.22 | 0.09 | 0.85 | 0.010 | 0.014 | 0.006 | 0.002 | 0.03 | 0.28 |
| Inventive Steel 5 | 0.07 | 0.80 | 2.3 | 0.031 | 0.004 | 0.04 | 0.12 | 0.50 | 0.005 | 0.017 | 0.004 | 0.001 | 0.03 | 0.31 |
| Inventive Steel 6 | 0.10 | 0.60 | 2.3 | 0.015 | 0.005 | 0.02 | 0.005 | 0.30 | 0.001 | 0.020 | 0.005 | 0.001 | 0.02 | 0.28 |
| Comparative Steel 1 | 0.08 | 0.20 | 2.3 | 0.009 | 0.001 | 0.25 | 0.07 | 0.02 | 0.012 | 0.013 | 0.004 | 0.0005 | 0.02 | 0.22 |
| Comparative Steel 2 | 0.15 | 0.21 | 1.8 | 0.025 | 0.002 | 0.02 | 0.03 | 0.21 | 0.021 | 0.003 | 0.005 | 0 | 0.02 | 0.19 |
| Comparative Steel 3 | 0.13 | 0.19 | 2.1 | 0.006 | 0.001 | 0.037 | 0.12 | 0.50 | 0.002 | 0.024 | 0.006 | 0.0001 | 0.02 | 0.13 |
| Comparative Steel 4 | 0.09 | 0.30 | 2.26 | 0.016 | 0.001 | 0.032 | 0.049 | 0.39 | 0.002 | 0.004 | 0.004 | 0.0007 | 0.02 | 0.16 |
| Comparative Steel 5 | 0.07 | 0.06 | 2.6 | 0.009 | 0.001 | 0.21 | 0.07 | 0.03 | 0.012 | 0.013 | 0.005 | 0.0005 | 0.002 | 0.13 |
| Comparative Steel 6 | 0.17 | 0.02 | 1.8 | 0.020 | 0.003 | 0.03 | 0.02 | 0.02 | 0.010 | 0.020 | 0.006 | 0.001 | 0.02 | 0.12 |

(In Table 1, the component ratio represents the value of Relationship 1 [(Si + Al + C)/(Mn + Mo + Cr)] for each steel.)

TABLE 2

| | Outlet | Coiling | Primary | Annealing | Secondary Cooling | | Third Cooling | | Final Cooling | |
|---|---|---|---|---|---|---|---|---|---|---|
| Classification | Temperature (° C.) | Temperature (° C.) | Cooling (° C./s) | Temperature (° C.) | Rate (° C./s) | Temperature (° C) | Rate (° C./s) | Temperature (° C.) | Rate (° C./s) | Temperature (° C.) |
| Inventive Steel 1 | 917 | 601 | 0.009 | 790 | 2.6 | 650 | 11.1 | 440 | 7.9 | 20 |
| Inventive Steel 2 | 902 | 650 | 0.013 | 820 | 3.2 | 655 | 10.9 | 450 | 7.5 | 43 |
| Inventive Steel 3 | 906 | 580 | 0.012 | 780 | 2.9 | 631 | 14.3 | 411 | 7.7 | 33 |

TABLE 2-continued

| Classification | Outlet Temperature (° C.) | Coiling Temperature (° C.) | Primary Cooling (° C./s) | Annealing Temperature (° C.) | Secondary Cooling Rate (° C./s) | Secondary Cooling Temperature (° C) | Third Cooling Rate (° C./s) | Third Cooling Temperature (° C.) | Final Cooling Rate (° C./s) | Final Cooling Temperature (° C.) |
|---|---|---|---|---|---|---|---|---|---|---|
| Inventive Steel 4 | 922 | 683 | 0.014 | 811 | 3.6 | 657 | 11.5 | 475 | 7.6 | 38 |
| Inventive Steel 5 | 901 | 645 | 0.011 | 780 | 2.3 | 662 | 15.3 | 428 | 7.8 | 27 |
| Inventive Steel 6 | 890 | 560 | 0.007 | 820 | 3.4 | 645 | 10.1 | 498 | 8.4 | 25 |
| Comparative Steel 1 | 860 | 350 | 2.3 | 760 | 1.2 | 640 | 14.1 | 430 | 7.7 | 30 |
| Comparative Steel 2 | 918 | 640 | 0.311 | 790 | 3.9 | 590 | 19.2 | 300 | 6.5 | 100 |
| Comparative Steel 3 | 791 | 100 | 0.011 | 810 | 2.7 | 670 | 8.1 | 540 | 7.5 | 44 |
| Comparative Steel 4 | 911 | 612 | 0.516 | 770 | 4.3 | 550 | 13.1 | 350 | 7.8 | 25 |
| Comparative Steel 5 | 892 | 530 | 8.3 | 840 | 3.1 | 680 | 8.3 | 550 | 7.7 | 33 |
| Comparative Steel 6 | 960 | 719 | 0.007 | 850 | 3.1 | 691 | 18.3 | 410 | 7.3 | 56 |

TABLE 3

| Classification | Microstructure (fraction %) F | B + A | Mt | Mb | Ms | Occupancy Ratio Mb/Mt | Ms/Mt | Mechanical Properties YS (MPa) | TS (MPa) | El (%) | YR | n | Relationship 2 | Unplated |
|---|---|---|---|---|---|---|---|---|---|---|---|---|---|---|
| Inventive Steel 1 | 43 | 29 | 28 | 22 | 21 | 79 | 75 | 421 | 836 | 21.2 | 0.50 | 0.207 | 7337 | Non-Occurence |
| Inventive Steel 2 | 47 | 33 | 20 | 18 | 17 | 90 | 85 | 406 | 781 | 22.1 | 0.52 | 0.223 | 7402 | Non-Occurence |
| Inventive Steel 3 | 42 | 25 | 33 | 24 | 23 | 73 | 70 | 447 | 889 | 20.1 | 0.50 | 0.181 | 6469 | Non-Occurence |
| Inventive Steel 4 | 47 | 29 | 24 | 18 | 17 | 75 | 71 | 420 | 809 | 19.1 | 0.52 | 0.196 | 5824 | Non-Occurence |
| Inventive Steel 5 | 50 | 20 | 30 | 20 | 20 | 67 | 67 | 413 | 836 | 19.3 | 0.49 | 0.194 | 6388 | Non-Occurence |
| Inventive Steel 6 | 43 | 38 | 19 | 12 | 12 | 63 | 63 | 431 | 793 | 19.1 | 0.54 | 0.191 | 5357 | Non-Occurence |
| Comparative Steel 1 | 57 | 15 | 28 | 15 | 15 | 54 | 54 | 478 | 821 | 16.1 | 0.58 | 0.171 | 3897 | Non-Occurence |
| Comparative Steel 2 | 48 | 16 | 36 | 17 | 16 | 47 | 44 | 521 | 876 | 17.6 | 0.59 | 0.148 | 3867 | Non-Occurence |
| Comparative Steel 3 | 47 | 15 | 38 | 13 | 15 | 34 | 39 | 512 | 891 | 16.5 | 0.57 | 0.155 | 3998 | Non-Occurence |
| Comparative Steel 4 | 60 | 20 | 20 | 6 | 6 | 30 | 30 | 502 | 795 | 18.8 | 0.63 | 0.149 | 3535 | Non-Occurence |
| Comparative Steel 5 | 58 | 14 | 28 | 8 | 10 | 29 | 36 | 491 | 840 | 13.8 | 0.58 | 0.145 | 2898 | Occurence |
| Comparative Steel 6 | 47 | 19 | 34 | 9 | 11 | 26 | 32 | 540 | 892 | 13.3 | 0.61 | 0.118 | 2294 | Occurence |

(In Table 3, F denotes ferrite, B denotes bainite, A denotes austenite, and Mt denotes the total fraction on fresh martensite. In addition, YS is yield strength, TS is tensile strength, El is elongation, YR is a yield ratio, and n is the strain hardening rate. Further, Relationship 2 illustrates the calculated value of [(n × El × TS)/YR].

In addition, the occupancy ratio is represented as a percentage, and is expressed by multiplying (Mb/Mt) value and (Ms/Mt) value by 100.)

As illustrated in Tables 1 to 3, in the case of inventive steels 1 to 6 in which the steel alloy composition, component ratio (Relationship 1) and manufacturing conditions satisfy all the suggestions of the present disclosure; it can be seen that as the intended microstructure is formed, not only the yield ratio is a low yield ratio of 0.6 or less, but also the value of (n×EI×TS)/YR exceeds 5000, thereby the workability is excellent.

In addition, it can be seen that all of Inventive Steels 1 to 6 have good plating properties.

Meanwhile, in the case of comparative steels 1 to 6 in which one or more of the steel alloy composition, component ratio, and manufacturing conditions deviated from those proposed in an exemplary embodiment of the present disclosure; the microstructure intended in an exemplary embodiment of the present disclosure could not be obtained, and thus, the yield ratio was high or the value of (n×EI×TS)/YR was secured to be less than 5000. Therefore, it can be seen that the workability was not improved.

Thereamong, in the case of Comparative Steels 5 and 6, the plating properties were also inferior and unplating occurred.

FIG. 2 illustrates the change in phase occupancy ratio (Mb/Mt) depending on the concentration ratio (corresponding to Relationship 1) between C, Si, Al, Mn, Mo and Cr at ¼ t thickness points of the inventive steel and the comparative steel.

As illustrated in FIG. 2, it can be seen that the intended structure may be obtained only when the concentration ratio between C, Si, Al, Mn, Mo and Cr is secured to be 0.25 or more.

Figure 3:
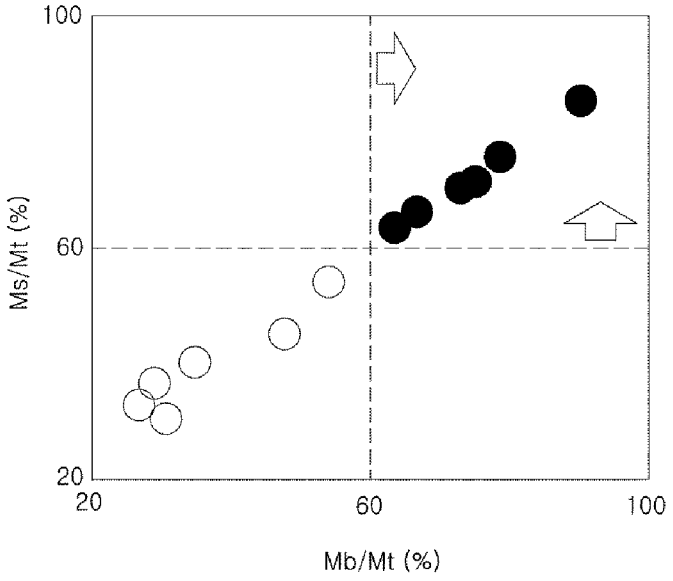
FIG. 3 illustrates a change in an occupancy ratio (Ms/Mt) on a fine fresh martensite phase depending on the phase occupancy ratio (Mb/Mt) in an exemplary embodiment of the present disclosure.

FIG. 3 illustrates the change in the occupancy ratio (Ms/Mt) of the fine fresh martensite phase depending on the phase occupancy ratio (Mb/Mt).

As illustrated in FIG. 3, it can be seen that the intended structure may be obtained when the occupancy ratio (Mb/Mt) of a fresh martensite phase adjacent to bainite is 60% or more.

Figure 4:
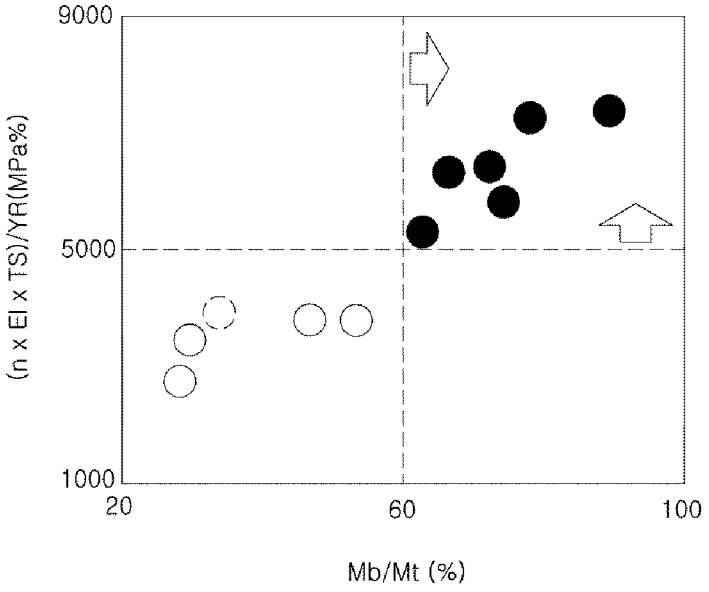
FIG. 4 illustrates a change in mechanical properties (corresponding to Relationship 2) depending on the phase occupancy ratio (Mb/Mt) in an exemplary embodiment of the present disclosure.

FIG. 4 illustrates the change in mechanical properties (corresponding to Relationship 2) depending on the phase occupancy ratio (Mb/Mt).

As illustrated in FIG. 4, it can be seen that the occupancy ratio (Mb/Mt) of the fresh martensite phase adjacent to bainite should be 60% or more to secure the value of (n×EI×TS)/YR of 5000 or more.

Figure 5:
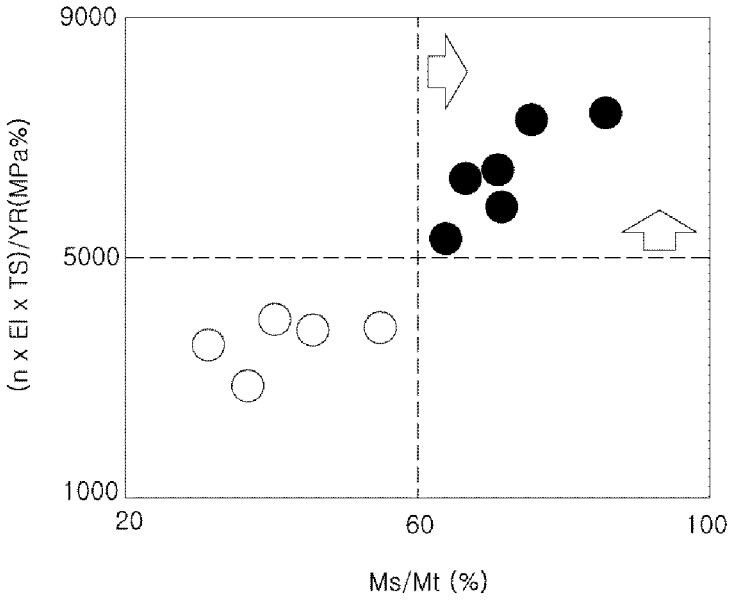
FIG. 5 illustrates a change in mechanical properties (corresponding to Relationship 2) depending on the occupancy ratio (Ms/Mt) of the fine fresh martensite phase in an exemplary embodiment of the present disclosure.

FIG. 5 illustrates the change in mechanical properties (corresponding to Relationship 2) depending on the occupancy ratio (Ms/Mt) of the fine fresh martensite phase.

As illustrated in FIG. 5, it can be seen that the value of (n×EI×TS)/YR is secured to be 5000 or more only when the occupancy ratio (Ms/Mt) of the fine fresh martensite phase is 60% or more.

What is claimed are:

1. A method of manufacturing a steel sheet, the method comprising:

reheating, at a temperature in a range of 1050 to 1300° C., a steel slab including, in weight %, 0.06 to 0.18% of carbon (C), 1.5% or less (excluding 0%) of silicon (Si), 1.7 to 2.5% of manganese (Mn), 0.15% or less (excluding 0%) of molybdenum (Mo), 1.0% or less (excluding 0%) of chromium (Cr), 0.1% or less of phosphorus (P), 0.01% or less of sulfur (S), 1.0% or less (excluding 0%) of aluminum (Al), 0.001 to 0.04% of titanium (Ti), 0.001 to 0.04% of niobium (Nb), 0.01% or less of nitrogen (N), 0.01% or less (excluding 0%) of boron (B), 0.05% or less (excluding 0%) of antimony (Sb), a remainder of Fe and other inevitable impurities;

preparing a hot-rolled steel sheet by finishing hot-rolling the reheated steel slab at an Ar3 transformation point or higher;

coiling the hot rolled steel sheet in a temperature range of 400 to 700° C.;

after the coiling, primary cooling at a cooling rate of 0.1° C./s or less to room temperature;

after the cooling, producing a cold rolled steel sheet by cold rolling at a cold reduction ratio of 40 to 70%;

continuously annealing the cold rolled steel sheet in a temperature range of Ac1+30° C. to Ac3-20° C.;

after the continuously annealing, performing a secondary cooling at a cooling rate of 10° C./s or less (excluding 0° C./s) to 630 to 670° C.;

after the secondary cooling, performing a third cooling to 400 to 500° C. at a cooling rate of 5° C./s or more in a hydrogen cooling facility;

maintaining at 400 to 500° C. for 70 seconds or more after the third cooling;

hot-dip galvanizing after the maintaining; and after the hot-dip galvanizing, performing a final cooling to Ms or less at a cooling rate of 1° C./s or more.

2. The method of claim 1, wherein in the steel slab, a relationship of C, Si, Al, Mn, Mo and Cr satisfies the following relation 1, $$(Si+Al+C)/(Mn+Mo+Cr) \geq 0.25 \quad \text{[Relationship 1]}$$

where respective elements indicate a weight content.

3. The method of claim 1, wherein a temperature at an outlet side during the finishing hot-rolling satisfies Ar3 to Ar3+50° C.

4. The method of claim 1, wherein a bainite phase is formed upon the third cooling.

5. The method of claim 1, wherein a fresh martensite phase is formed upon the final cooling after the hot-dip galvanizing.

6. The method of claim 1, wherein the hot-dip galvanizing is performed in a zinc plating bath at 430 to 490° C.

7. The method of claim 1, further comprising temper rolling at a reduction ratio of less than 1.0% after the final cooling.

* * * * *